United States Patent [19]

Robins

[11] 4,295,022

[45] Oct. 13, 1981

[54] TRIFURCATED ARC RUNNER

[75] Inventor: Charles T. Robins, Swarthmore, Pa.

[73] Assignee: Gould Inc., Rolling Meadows, Ill.

[21] Appl. No.: 20,767

[22] Filed: Mar. 15, 1979

[51] Int. Cl.[3] ..... H01H 33/20

[52] U.S. Cl. ..... 200/147 R; 200/144 R; 200/146 R

[58] Field of Search ..... 200/147 R, 144 R, 146 R

[56] References Cited

U.S. PATENT DOCUMENTS

| | | | |
|---|---|---|---|
| 2,467,937 | 4/1949 | Jackson | 200/147 R |
| 3,114,814 | 12/1963 | Stettner | 200/147 R |
| 3,441,697 | 4/1969 | Wingard | 200/147 R |
| 3,784,775 | 1/1974 | Gryctko | 200/147 R |
| 4,086,460 | 4/1978 | Gillette | 200/147 R |

FOREIGN PATENT DOCUMENTS

| | | | |
|---|---|---|---|
| 89227 | 4/1967 | France | 200/147 R |

*Primary Examiner*—Robert S. Macon

*Attorney, Agent, or Firm*—Harold Huberfeld; Jerome M. Berliner; Bernard Gerb

[57] ABSTRACT

A relatively high current capacity molded case circuit breaker having arcing and main contacts and an arc chute to receive and extinguish arcs drawn between the arcing contacts is provided with a trifurcated magnetic arc runner extending from the stationary arcing contact well into the arc chute. The outer sections or legs of the arc runner extend generally parallel to the forward surface of the terminal strap on which the stationary contacts are mounted, and the center leg of the arc runner is curved forward so that the free end of the center leg extends forward of a substantial number of plates in the arc chute. The center leg is shaped so that during opening of the circuit breaker the movable arcing contact moves in close proximity to the center leg and in so doing encourages arcs which may form between the main contacts to extinguish rapidly.

10 Claims, 6 Drawing Figures

299
232
231
240
233
300
303
301
310
306
302
4
5
6
136

3
288
242

020767

TRIFURCATED ARC RUNNER

This invention relates to molded case circuit breakers in general and more particularly relates to an arc runner which facilitates entry of electric current arcs into an arc chute.

Circuit breakers of high current ratings are provided with separate arcing and main contacts. In moderately high current rated breakers, arcing is confined to the arcing contact and a spaced plate type of chute is provided to receive and extinguish arcs formed on the arcing contact. However, as current ratings increase, some initial arcing often takes place at one or more of the main stationary contacts. This condition has proven to be very serious in that there is normally no arc extinguishing means in the vicinity of the main contacts, so that arcs formed thereon "hang on" for an excessive period of time causing severe pitting of the main contacts.

In accordance with the prior art, arc runners have been associated with the arcing contacts, being positioned more deeply in the arc chute than the arcing contacts, as described in U.S. Pat. No. 4,086,460 issued Apr. 25, 1978 to S. F. Gillette for a Circuit Breaker Having Improved Line Strap Construction.

For those structures in which arcing occurred at the main contacts, methods other than arc runners were employed to prevent arcs at the main contacts from being made interrupting points of the circuit. To accomplish this, the prior art has utilized insulating shields positioned between the main contacts and the plates of the arc chute. With such construction, if arcing occurred at the main contacts, this arcing was blocked from proceeding into the arc chute, but was expected to extinguish if and when arcing was transferred to the arcing contact and its associated runner.

For very high current rated breakers, it has been found that arching on the main contact does not always transfer to the stationary arcing contact, and if the main contacts are insulated from the arc chute, excessive damage will occur as a result of the arc "hanging on" to the main contacts. One prior art solution for this problem is shown in U.S. Pat. No. 3,784,775 issued Jan. 8, 1974, to C. E. Gryctko for an Arc Runner Between Stationary Contacts, wherein a magnetic arc runner is provided between the main contacts and the arcing contact, so that arcs established at the main contacts are attracted to the magnetic arc runner which directs these arcs to the arcing contact, where the arcs enter the arc chute associated with the arcing contact and are extinguished. While this prior art solution has been effective, it does not make optimum use of the arc chute for extinguishing arcs.

In accordance with the instant invention, utilization of arc chute capability is improved by controlling dispersal of the arc particularly as it enters the arc chute. This is accomplished by providing a trifurcated arc runner which extends between the stationary arcing contact and the arc chute. That is, the arc runner includes a center section flanked by two outer sections. The latter extend into the arc chute at the rear thereof being closely spaced with respect to the terminal strap for substantially their entire lengths. The center section, on the other hand, is curved sharply forward to terminate substantially forward of a number of the plates in the arc chute. This construction distributes the arc over a great area of the arc chute and encourages rapid utilization of many plates in the arc chute to promote arc extinction. The center arc runner section is contoured so that during contact opening there is a minimum air gap maintained between the arcing contact and arc runner for a relatively long period of time thereby reducing the tendency for the arc to hang on the main contacts.

Accordingly, a primary object of the instant invention is to provide means for promoting more complete utilization of arc chute capability for interrupting arcs drawn upon the opening of a circuit breaker.

Another object is to provide means of this type which reduces the tendency for the arc to hang on the main contacts.

Still another object is to provide an arc runner having a plurality of sections extending parallel to the line terminal strap and another section which curves forward of the line terminal strap and terminates well forward of a substantial number of the arc chute plates.

These objects as well as other objects of this invention shall become readily apparent after reading the following description of the accompanying drawings in which.

Figures 2, 3:
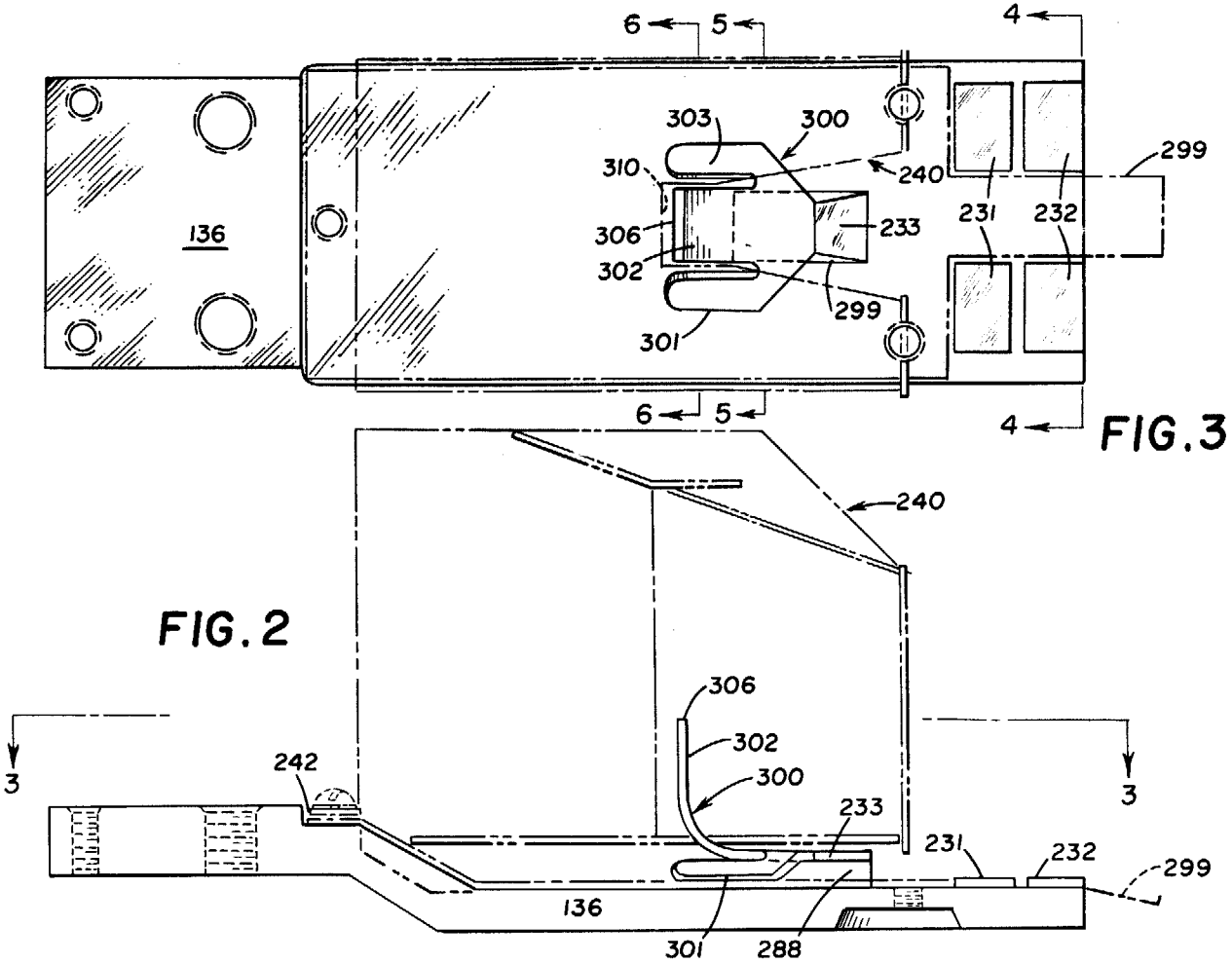
FIG. 2 is an enlarged side elevation of the line terminal assembly of FIG. 1, including the stationary contacts, arc runner and arc chute mounted thereon, with some of these elements being shown in phantom.
FIG. 3 is a plan view of the elements of FIG. 2 with the arc chute removed, looking in the direction of arrows 3—3.
Figure 5:
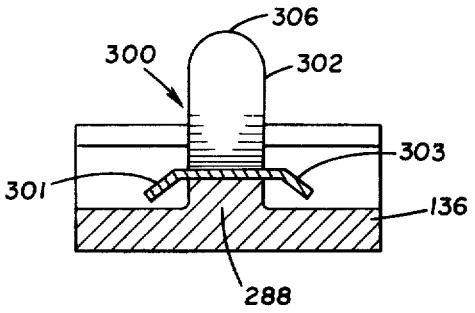
Figure 6:
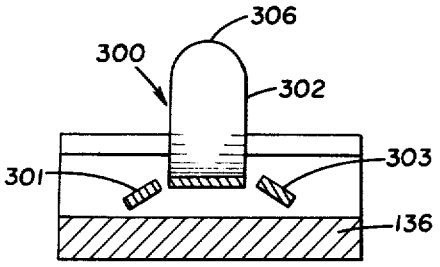

FIGS. 5 and 6 are cross-sections of FIG. 3 taken through the respective lines 5—5 and 6—6 looking in the direction of arrows 5—5.

Now referring to the Figures. Multipole circuit breaker 25 is of the type described in the aforesaid U.S. Pat. No. 3,784,775 and prior art referred to therein. Briefly, circuit breaker 25 includes a molded housing constructed of base 26 and removable cover 27 abutting at interface 28. The main current path through each pole of circuit breaker 25 is identical and consists of load terminal strap 61 connected by a plurality of flexible conductors 120, 121 to the groups of movable main contacts 103, 107 engaged with groups of stationary main contacts 231, 232, respectively, at opposite sides of line terminal strap 136 and brazed or otherwise secured thereto at one end and on the upper or forward surface thereof.

Movable arcing contact 101, mounted at the forward end of arm 112, is engageable with stationary arcing contact 233, mounted on forward protrusion 288 of terminal strap 136 and positioned forward of stationary main contacts 231, 232. All of the movable contacts 101, 103, 107 are mounted to contact carrier 45 that is pivotally mounted to mechanism frame 36, secured to base 26 by bolts 48. Contact carrier 45 is connected at pivot 46 at one end of lower toggle link 43 whose other end is connected to toggle knee 41. Upper toggle link 42 extends between knee 41 and pivot 44 on cradle 40, with the latter being pivotally mounted at 47 to frame 36.

Transverse cradle portion **40*a* mounts latch plate 51, engageable by secondary latch 53, which is connected to primary latch 65, pivoted on trip unit frame 60 at stub shaft 69. Primary latch 65 is in turn engageable by the latch plate portion of carrier 66, to maintain cradle 40 in the latched position shown in FIG. 1, wherein circuit breaker 25 may be operated from its open position of FIG. 1 to its closed position. When carrier 66 releases latch train 53, 65, the movement of cradle 40 is transmitted back through latch train 53, 65, whereby transverse pin 71 is moved by primary latch 65 to pivot carrier 66 about shaft 68, thereby moving transverse common trip bar 80** to release the latch systems of all other poles.

Instantaneous trip means in the form of stationary magnetic frame members 96, 98 and movable armature 78 is provided. Also provided is a delay trip means in the form of bimetal strip 77 mounted to insulating member 95 on trip unit frame 60.

Transverse insulation bar 147 extends through tubular members 146 at the rear of each contact carrier 45 to mechanically connect the contact carriers 45 of all poles. Aligned apertures 148 in the sides of frame 36 provide clearance for movement of bar 147. Toggle 42, 43 is operated by spring means (not shown) connected between plate 39, on toggle knee 41, and the upper end of operating member 35 pivoted at its lower end to frame 36. Member 35 is connected by studs 34 to circuit breaker operating handle 30, which is provided with stubby bifurcated extension 33 projecting through aperture 29 in housing cover 27. Handle extension 33 mounts roller 222 that is engaged by the operating elements 235 of auxiliary handle operating mechanism 250, having main operating handle 253 for moving elements 235.

During normal operation, as movable contacts 101, 103, 107 separate from stationary contacts 233, 231, 232 respectively, arcing will be confined to arcing contacts 101, 233. The arc formed between arcing contacts 101, 233 is drawn deeply into spaced plate type arc chute 240, having upper and lower magnetic arc runners 241, 242, with the latter being secured to the front surface of terminal strap 136 by screw 243 and thin insulating sheet 299 being interposed between lower runner 242 and strap 136.

Figure 4:
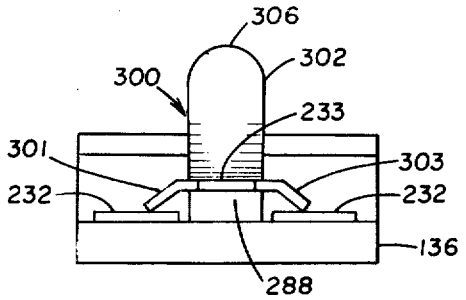
FIG. 4 is an end view looking in the direction of arrows 4—4 of FIG. 3.

In accordance with the instant invention, trifurcated arc runner 300, constructed of magnetic steel, is secured to the front surface of terminal strap protrusion 288, abuts stationary arcing contact 233 and extends away from stationary main contacts 231, 232. More particularly, arc runner 300 includes three transversely spaced sections 301, 302, 303 which extend generally parallel to the longitudinal axis of line terminal strap 136. Outer sections 301, 303 of arc runner 300 are positioned in planes which are slightly inclined with respect to the forward surface of line terminal strap 136 (FIG. 4). However, the spacing between each of the outer sections 301, 303 and the front surface of strap 136 is relatively small and is substantially constant when measured along a line parallel to the longitudinal axis of strap 136.

Figure 1:
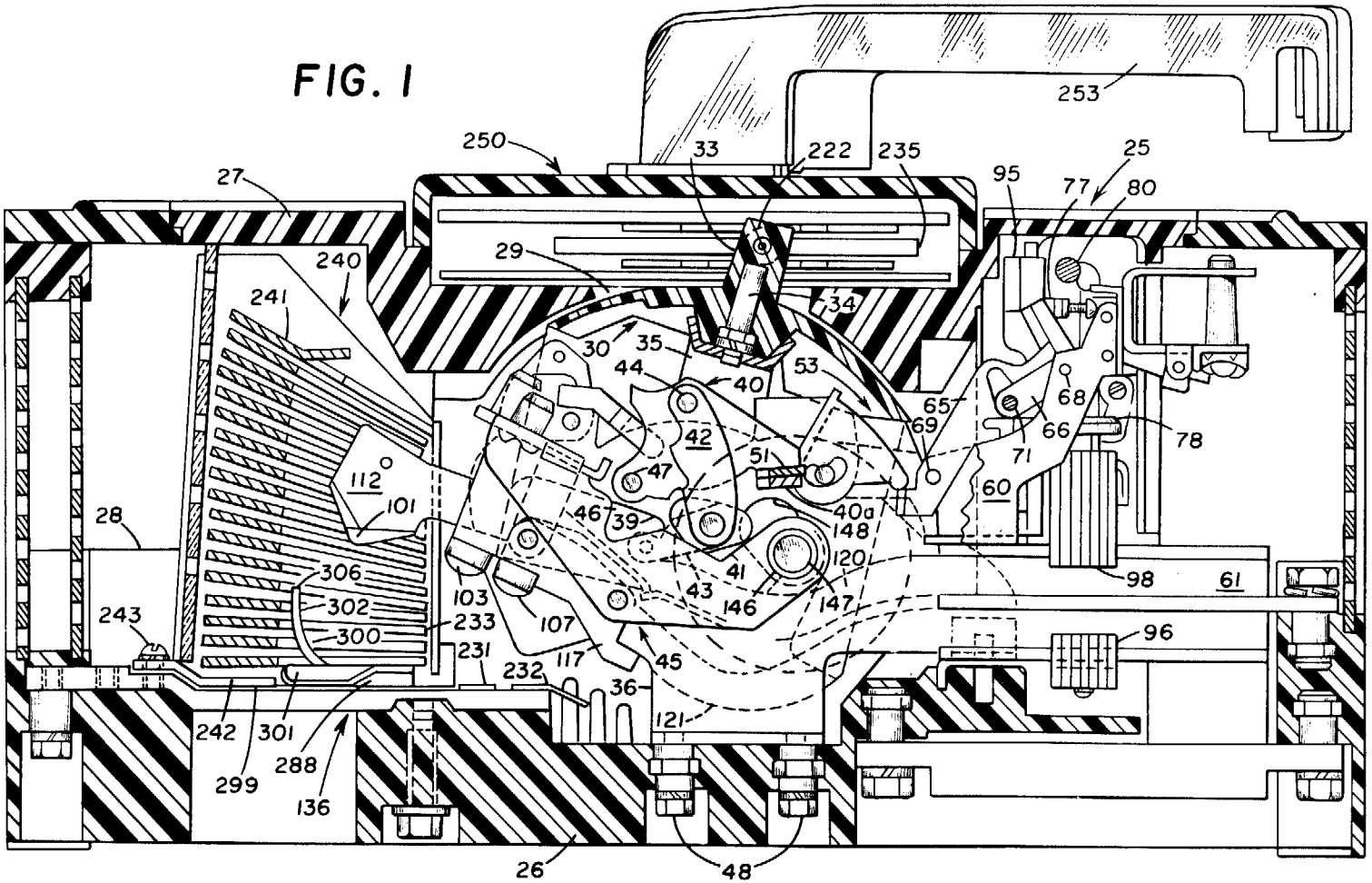
FIG. 1 is a longitudinal cross-section of a multipole circuit breaker, showing the elements of one pole thereof, including a trifurcated arc runner constructed in accordance with teachings of the instant invention.

As seen best in FIGS. 1 and 2, center section 302 of arc runner 300 curves sharply forward or away from the front surface of strap 136, with the free end 306 of center section 302 extending forward of a substantial number of the plates in arc chute 240 and terminating adjacent the narrow section of the tapered mouth 310 at the entrance to arc chute 240.

To promote transfer of arcs from main contacts 103, 107, 231, 232 to arcing contacts 101, 233, the center leg 302 of arc runner 300 is contoured so that upon opening of circuit breaker 25 there is a substantial period of time during which movable contact arm 112 remains very close to curved leg 302.

Thus, it is seen that the instant invention provides trifurcated arc runner 300 which is shaped in a manner such that improved direction and dispersal of electric current arcs is obtained. In particular, the arc is not only driven deeply into arc chute 240 but a section of the arc is induced to move very rapidly to the front of the arc chute, thereby distributing the arc over a large area of many of the arc plates in a very short period of time.

Although this invention has been described with respect to its preferred embodiments, it should be understood that many variations and modifications will now be obvious to those skilled in the art, and it is preferred, therefore, that the scope of this invention be limited, not by the specific disclosure herein, but only by the appended claims.

What is claimed is:

1. A circuit breaker including an elongated conducting strap having first and second ends; stationary contact means mounted on said strap and positioned in front of a first face thereof at said first end; said stationary contact means including a stationary arcing contact section and a stationary main contact section positioned closer to said first end than said stationary arcing contact section; movable contact means including movable arcing and main contact sections operable into and out of engagement with the respective stationary arcing and main contact sections; arc chute means to receive and extinguish electric current arcs drawn between said movable and stationary contact means upon separation thereof; said arc chute means being positioned in front of said first face and interposed between said stationary contact means and said second end; arc runner means in front of said first face and in electrical contact with said stationary arcing contact section and extending therefrom toward said second end; said arc runner means including at its end remote from said stationary main contact section a plurality of transversely spaced sections for dispersing various arc sections into different regions of said arc chute means.

2. A circuit breaker as set forth in claim 1 in which a first of said arc runner means sections at its free end remote from said stationary contact means is disposed substantially forward of a second of said arc runner means sections at its free end remote from said stationary contact means.

3. A circuit breaker as set forth in claim 2 in which said first arc runner means section at its said free end is disposed substantially forward of a third of said arc runner means sections at its free end remote from said stationary contact means; said first arc runner means section being longitudinally aligned with said stationary arcing contact section and being disposed between said second and third arc runner means sections.

4. A circuit breaker as set forth in claim 3 in which said first arc runner means section from its said free end is inclined forward and toward said first end.

5. A circuit breaker as set forth in claim 3 in which said first arc runner means section from its said free end is curved forward and toward said first end.

6. A circuit breaker as set forth in claim 4 in which said movable arcing contact means when operated to its open circuit position moves in close proximity to said first arc runner means section for substantially its entire length.

7. A circuit breaker as set forth in claim 4 in which the outboard edges of said second and third arc runner means sections are more rearward than are the inboard edges thereof.

8. A circuit breaker as set forth in claim 4 in which said arc chute means includes a plurality of plates spaced from each other in a face-to-face stack with the rear faces of said plates facing said first face of said strap; said free end of said first arc runner means section is disposed forward of at least one fourth the number of said plurality of plates.

9. A circuit breaker as set forth in claim 4 in which the arc chute means includes an entrance which tapers from a relatively wide section at said stationary arcing contact section to a relatively narrow section which is closer to said second end than is the wide section; said free end of said first arc runner means section extending to the vicinity of said narrow section.

10. A circuit breaker as set forth in claim 9 in which said arc chute means includes a plurality of plates spaced from each other in a face-to-face stack with the rear faces of said plates facing said first face of said strap; said free end of said first arc runner means section being disposed forward of at least one fourth the number of said plurality of plates; at least portions at said free ends of said second and third arc runner means sections extending behind face portions of at least some of said plates.

* * * * *